US008453298B2

(12) United States Patent
Nichols et al.

(10) Patent No.: US 8,453,298 B2
(45) Date of Patent: Jun. 4, 2013

(54) DOOR HINGE SYSTEM FOR AUTOMOTIVE VEHICLE

(75) Inventors: Jon Nichols, Georgetown, TX (US); John Van Dyk, Plymouth, MI (US)

(73) Assignee: Ford Global Technologies, Dearborn, MI (US)

( * ) Notice: Subject to any disclaimer, the term of this patent is extended or adjusted under 35 U.S.C. 154(b) by 1471 days.

(21) Appl. No.: 11/465,498

(22) Filed: Aug. 18, 2006

(65) Prior Publication Data

US 2008/0040888 A1 Feb. 21, 2008

(51) Int. Cl.
*E05D 3/06* (2006.01)

(52) U.S. Cl.
USPC ..... 16/366

(58) Field of Classification Search
USPC ..... 16/366, 372, 369, 368, 370, 286–288
See application file for complete search history.

(56) References Cited

U.S. PATENT DOCUMENTS

| | | | | | |
|---|---|---|---|---|---|
| 758,530 | A | * | 4/1904 | Gross | 5/58 |
| 1,019,096 | A | * | 3/1912 | Soss | 16/368 |
| 1,554,161 | A | * | 9/1925 | Hubbard | 16/368 |
| 2,206,708 | A | * | 7/1940 | Stumpf | 16/358 |
| 4,470,170 | A | | 9/1984 | Gerteis | |
| 4,738,003 | A | | 4/1988 | Mori et al. | |
| 5,062,182 | A | * | 11/1991 | Griffiths et al. | 16/368 |
| 5,244,247 | A | | 9/1993 | Kuwabara | |
| 5,491,875 | A | * | 2/1996 | Siladke et al. | 16/346 |
| 5,561,887 | A | * | 10/1996 | Neag et al. | 16/334 |
| 5,685,046 | A | * | 11/1997 | Neag et al. | 16/366 |
| 5,833,300 | A | * | 11/1998 | Russke | 296/108 |
| 6,175,991 | B1 | * | 1/2001 | Driesman et al. | 16/366 |
| 6,382,705 | B1 | | 5/2002 | Lang et al. | |
| 6,591,452 | B2 | * | 7/2003 | Jacquin | 16/332 |
| 6,834,834 | B2 | * | 12/2004 | Dazet et al. | 244/129.5 |
| 6,842,944 | B2 | | 1/2005 | Maurer | |
| 6,842,945 | B2 | * | 1/2005 | Hiramatsu | 16/366 |
| 6,942,277 | B2 | | 9/2005 | Rangnekar et al. | |

FOREIGN PATENT DOCUMENTS

GB 2261022 A * 5/1993

OTHER PUBLICATIONS

"C pillar wiki", wikipedia article, found May 12, 2008.*

* cited by examiner

*Primary Examiner* — Victor Batson
*Assistant Examiner* — Emily Morgan
(74) *Attorney, Agent, or Firm* — Jerome R. Drouillard; Jason Rogers

(57) ABSTRACT

A door hinge system for an automotive vehicle includes a hinge body which is pivoted at one end to a vehicle body and a second end to a door. A central control link is pivotably affixed to the hinge body and has body and door control links extending to the vehicle body and door, respectively. The central control link and its connecting linkages control the attitude of the door and allow it to be opened far in excess of 90 degrees to the vehicle body without interference with the body.

9 Claims, 3 Drawing Sheets

DOOR HINGE SYSTEM FOR AUTOMOTIVE VEHICLE

FIELD OF THE INVENTION

The present invention relates to a hinge system which is ideally suited for mounting exterior doors to the passenger cabin of an automotive vehicle.

DISCLOSURE INFORMATION

In order to improve the accessibility of the rearwardmost part of passenger cabins commonly utilized with pickup truck vehicles, it is desirable to open the rear door of the vehicle more than 90 degrees. This necessitates that a improved hinge be provided, because a single pivot hinge is generally not capable of accomplishing this function unless the hinge is externally mounted, which is detrimental to the appearance of the vehicle. U.S. Patent Application Publication 2005/0134084 discloses a double pivot hinge having a spring and latch mechanism for controlling the action of the hinge. Unfortunately, such spring and latch mechanisms are subject to undue wear and may increase the effort required to swing the door, while also increasing the likelihood that premature wear of the hinge mechanism will result in unsatisfactory operation of the door unit.

A hinge system according to the present invention provides a dual pivot action sufficient to allow door opening to at least 170 degrees, combined with a control linkage which accurately positions the door's attitude, thereby allowing opening of the door without interference between the door and adjacent body structures such as a C-pillar.

SUMMARY OF THE INVENTION

A door hinge system for an automotive vehicle includes a hinge body having a first portion pivotably attached to a door, and a second portion pivotably attached to a vehicle body. A central control link has a first link end and a second link end, with the central link itself being pivotably attached to the hinge body. A body link having a first end pivotably attached to the vehicle body has a second end pivotably attached to the first link end of the central control link. Finally, a door link has a first end pivotably attached to the door and a second end pivotably attached to the second link end of the central control link.

A hinge body according to the present invention preferably includes a rigid, C-shaped member having a first end pivotably attached to a vehicle door, and a second end pivotably attached to a vehicle body. In the accompanying illustrations, the second end of the hinge body is shown as being attached to a C-pillar portion of a pickup truck body. A central control link is attached to the hinge body at a location offset laterally from a line connecting the pivot points at which the hinge body is attached to the door and to the vehicle body. Further, the central control link is attached to the hinge body at a location which is offset longitudinally from the center of a line which is parallel to a line connecting the pivot points at which the hinge body is attached to the door and to the vehicle body.

The hinge body is attached to the door and to the vehicle body for rotation about generally vertical axes.

According to another aspect of the present invention, a door system for an automotive vehicle preferably includes upper and lower hinge assemblies which are substantially similar.

It is an advantage of a system according to the present invention that a vehicle door, which may be rearward opening, may be accurately located so as to allow opening of the door far beyond 90 degrees without interference between the door and the adjacent vehicle body, while at the same time allowing a tight margin between the door and body when the door is in its closed position.

It is a further advantage of a hinge system according to the present invention that the door is accurately located without the need for springs, latches, or other devices which are prone to premature wear.

It is yet another advantage of the present invention that the system may be adapted for use with various doors opening to different extents, by adjusting the present control link mechanism.

Other advantages, as well as features and objects of the present invention, will become apparent to the reader of this specification.

DETAILED DESCRIPTION OF THE PREFERRED EMBODIMENTS

Figure 1:
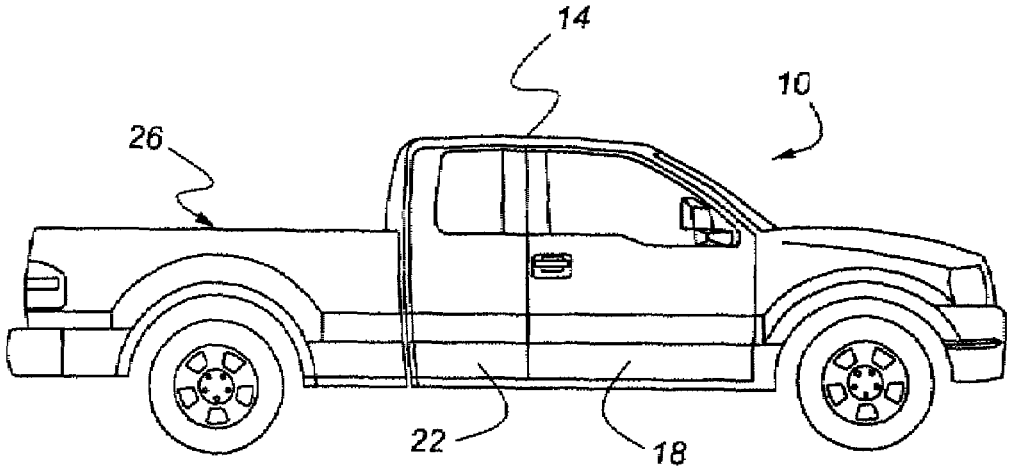
FIG. 1 is a side view of a vehicle having a door hinge system according to the present invention.

As shown in FIG. 1, vehicle 10 has a body, 14, with a front door 18, a rear door, 22, and a pickup box, 26. Those skilled in the art will appreciate in view of this disclosure that the present door hinge system could be employed with other types of vehicles in addition to that illustrated in the various figures.

Figure 2:
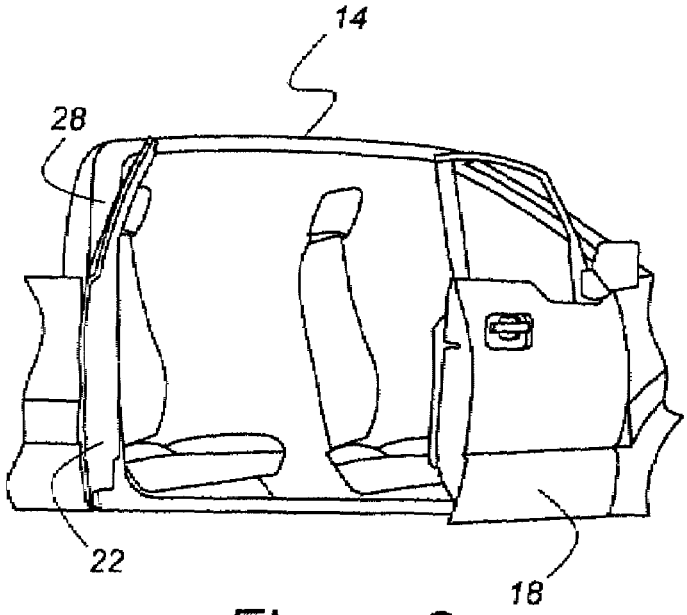
FIG. 2 shows the vehicle of FIG. 1 with the front and rear doors in open positions, with the rear door being open to about 90 degrees.

FIG. 2 shows the vehicle of FIG. 1 with the rear door 22 being open to about a 90 degree position. Rear door 22 is attached to C-pillar 28.

Figure 3:
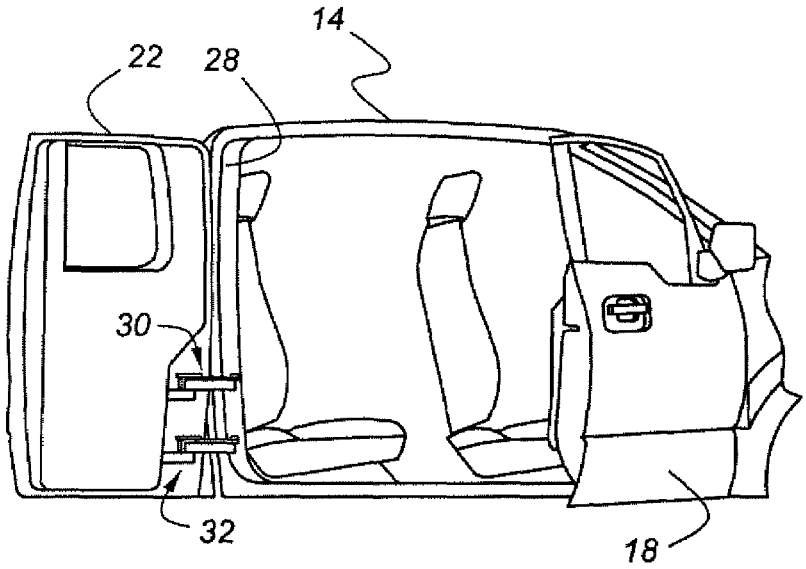
FIG. 3 shows the rear door of the vehicle of FIGS. 1 and 2 being open to about 170 degrees.

FIG. 3 shows C-pillar 28 in additional detail but also shows upper hinge assembly 30 and lower hinge assembly 32. In a preferred embodiment, the upper and lower hinge assemblies are substantially similar, with the upper assembly 30 being located at approximately the beltline of the vehicle and the lower hinge assembly 32 being located between the beltline and the rocker panel of the vehicle.

Figure 4:
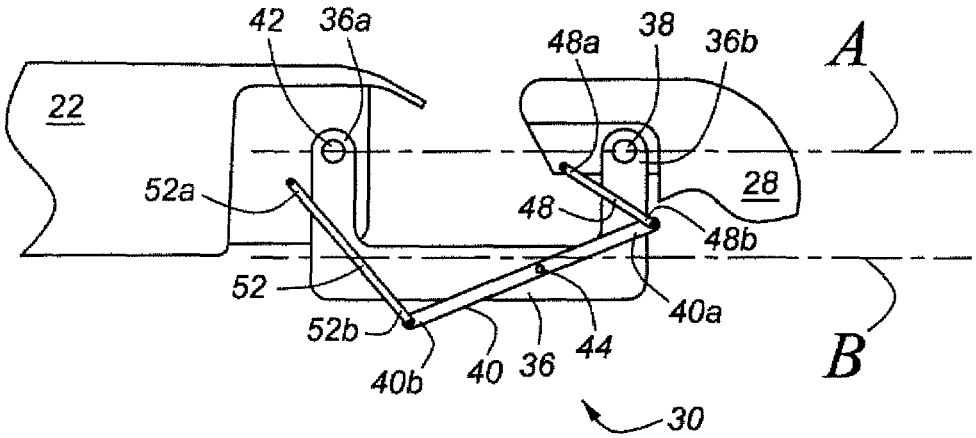
FIG. 4 is a plan view of the present hinge system as installed in the vehicle of FIGS. 1-3, showing the rear door of the vehicle in the closed position.

Moving now to FIG. 4, hinge body 36 is shown as being attached at a first portion, 36*a*, to door 22, and at a second portion, 36*b*, to C-pillar 28. A central control link, 40, has a first link end 40*a*, and a second link end 40*b*. Central control link 40 is pivotably attached at pivot 44 to hinge body 36. Door 22 is shown as fully closed in FIG. 4.

The attitude of door 22 with respect to body 14 and C-pillar 28, in particular, is governed by the action of central control link 40 and its connecting links, namely body link 48 and door link 52. Accordingly, central control link 40 has a first link end, 40*a*, which is attached to second end 48*b* of body link 48. In similar fashion, second link end 40*b* of central control link 40 is attached to second end 52*b* of door link 52. The first end, 48*a*, of body link 48 is attached to C-pillar 28, and the first end 52*a*, of door link 52 is attached to door 22.

As noted above, FIG. 4 illustrates door 22 in a closed position.

Figure 5:
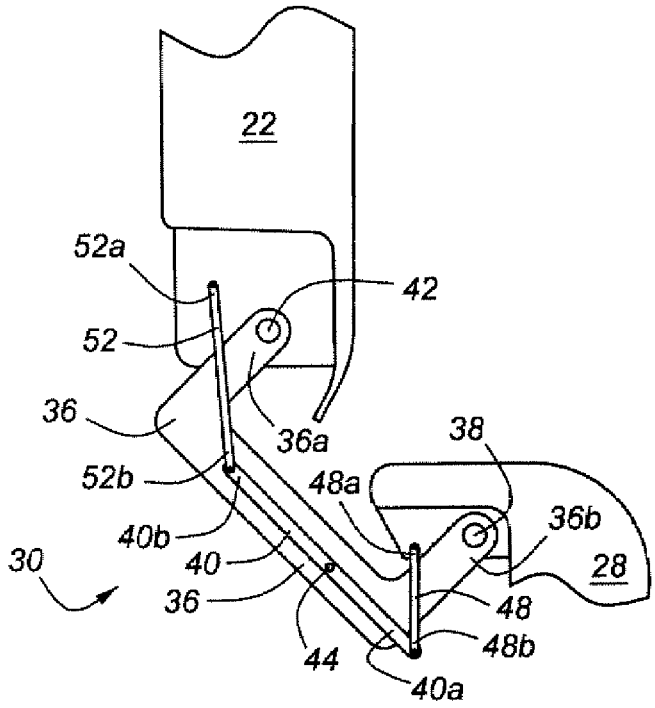
FIG. 5 illustrates the present hinge when the rear door in the position of FIG. 2.

Moving now to FIG. 5, it is seen that door 22 is at a 90 degree position and the rotational orientation of central control link 40 is such that the central control link is almost parallel to the central portion of hinge body 36.

Figure 6:
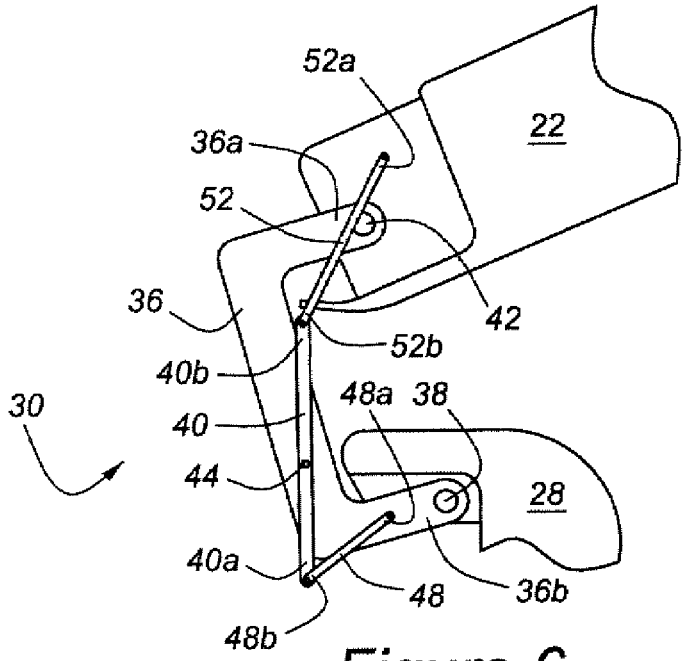
FIG. 6 illustrates the present hinge while the rear door is in the position of FIG. 3.

Moving now to FIG. 6, wherein door 22 is open at approximately 170 degrees from its closed position, it is seen that the rotational orientation of central control link 40 is at a maximum in terms of its angular travel from the position of FIG. 4.

Central control link 40, when combined with body link 48 and door link 52, controls the attitude of door 22 in an adjustable manner because of the placement of pivot 44. As seen most easily in FIG. 4, pivot 44 is located off the midpoint of control link 40 and it is also offset laterally from imaginary line A, which connects the pivot points at which C-shaped hinge body 36 is connected with door 22 and C-pillar 28. Note also that pivot point 44 is shifted toward C-pillar 28 from the center of a segment of imaginary line B lying between perpendiculars dropped through pivot point 38, which is the body pivot of hinge body 36, and door pivot 42.

While particular embodiments of the invention have been shown and described, numerous variations and alternate embodiments will occur to those skilled in the art. Accordingly, it is intended that the invention be limited only in terms of the appended claims.

What is claimed is:

1. A door hinge system for an automotive vehicle, comprising:

a hinge body having a first portion pivotably attached to a door, and a second portion pivotably attached to a vehicle body;

a central control link having a first link end and a second link end, with said central control link being pivotably attached to said hinge body at a location offset laterally from a line connecting the pivot points at which said hinge body is attached to said door and said vehicle body, with said control link being attached at a position mediate said first and second links ends;

a body link having a first end pivotably attached to said vehicle body, and a second end pivotably attached to the first link end of said central control link; and a door link having a first end pivotably attached to said door, and a second end pivotably attached to the second link end of said central control link.

2. A door hinge system according to claim 1, wherein said hinge body comprises a rigid, C-shaped member having a first end pivotably attached to said door and a second end pivotably attached to said vehicle body.

3. A door hinge system according to claim 1, wherein said second portion of said hinge body is pivotably attached to a C pillar portion of a vehicle body.

4. A door hinge system according to claim 1, wherein said hinge body is attached to said door and to said vehicle body for rotation about generally vertical axes.

5. A door hinge system according to claim 1, wherein said central control link is attached to said hinge body at a location offset longitudinally from the center of a line which is parallel to a line connecting the pivot points at which said hinge body is attached to said door and said vehicle body.

6. A door system for an automotive vehicle, comprising:

a door adapted for swinging about a generally vertical axis;

an upper hinge body having a first end pivotably attached to an upper portion of said door, and a second end adapted for pivotable attachment to an upper portion of a vehicle body;

and upper central control link having a first link end and a second link end, with said central control link being pivotably attached to said upper hinge body at a location offset laterally from a line connecting the pivot points at which said hinge body is attached to said door and said vehicle body, with said control link being attached at a position mediate said first and second link ends;

a body link having a first end adapted for pivotable attachment to said vehicle body, and a second end pivotably attached to the first link end of said upper central control link;

a door link having a first end pivotably attached to said door and a second end pivotably attached to the second link end of said upper central control link;

a lower hinge body having a first end pivotably attached to a lower portion of said door, and a second end adapted for pivotable attachment to a lower portion of a vehicle body;

a lower central control link having a first link end and a second link end, with said central control link being pivotably attached to said lower hinge body at a location offset laterally from a line connecting the pivot points at which said hinge body is attached to said door and vehicle body, with said control link being attached at a position mediate said first and second link ends;

a body link having a first end adapted for pivotable attachment to said vehicle body, and a second end pivotably attached to the first link end of said lower central control link;

a door link having a first end pivotably attached to said door and a second end pivotably attached to the second link end of said lower central control link.

7. An automotive vehicle, comprising:

a body having a passenger compartment with a door opening;

a door sized to fit said door opening;

a hinge body having a first end pivotably attached to said door, and a second end pivotably attached to said body, such that said door may be rotated about a plurality of generally vertical axes;

a central control link having a first link end and a second link end, with said central control link being pivotably attached to said hinge body at a location offset laterally from a line connecting the pivot points at which said hinge body is attached to said door and said vehicle body, with said control link being attached at a position mediate said first and second link ends;

a body link having a first end pivotably attached to said vehicle body, and a second end pivotably attached to the first link end of said central control link; and a door link having a first end pivotably attached to said door, and a second end pivotably attached to the second link end of said central control link.

8. An automotive vehicle according to claim 7, wherein said second end of said hinge body is attached to a C pillar of said body.

9. An automotive vehicle according to claim 7, wherein said hinge body comprises a C-shaped member.

* * * * *